United States Patent [19]

Kobayashi et al.

[11] Patent Number: 4,850,163

[45] Date of Patent: Jul. 25, 1989

[54] FREE-ACCESS FLOOR

[75] Inventors: Tokuzo Kobayashi; Iwao Watanabe, both of Okayama, Japan

[73] Assignee: O M Kiki Co., Ltd., Okayama, Japan

[21] Appl. No.: 145,884

[22] Filed: Jan. 20, 1988

[30] Foreign Application Priority Data

Jan. 21, 1987 [JP] Japan ..... 62-013235

[51] Int. Cl.[4] ..... E04B 5/43; E04B 5/48

[52] U.S. Cl. ..... 52/126.6; 52/221

[58] Field of Search ..... 52/126.6, 263, 461, 52/462, 465, 221

[56] References Cited

U.S. PATENT DOCUMENTS 898,045 8/1908 Gonon ..... 52/390
3,290,844 12/1966 Rushton et al. ..... 52/461
3,396,501 8/1968 Tate ..... 52/263
3,811,237 5/1974 Bettinger ..... 52/263
4,426,824 1/1984 Swensen ..... 52/794

*Primary Examiner*—James L. Ridgill, Jr.
*Attorney, Agent, or Firm*—Koda and Androlia

[57] ABSTRACT

Steps are formed around the peripheries of respective floor panels, so that wiring channels are formed between the side surfaces of adjacent floor panels when said floor panels are installed. As a result, the laying of power cables and communications cables on the floor surface, which is impossible in the case of conventional free-access floors, is made possible. Furthermore, these wiring channels are covered by wiring covers, thus eliminating any indentations or projections in the floor surface and providing a flat floor surface.

1 Claim, 4 Drawing Sheets

FREE-ACCESS FLOOR

BACKGROUND OF THE INVENTION (1) Industrial Field Utilizing the Invention

The present invention concerns a free-access floor which allows power cables and communications cables to be laid on a floor surface.

(2) Prior Art

In conventional free-access floors consisting of rigid panels, wiring space has for the most part been located only underneath the floor panels. As a result, power cables and communications cables are mixed together in the same underfloor space in the case of such free-access floors.

Meanwhile, no free-access floor which allows the formation of a wiring space above the floor surface has yet been developed. For example, no such disclosure is found in U.S. Pat. No. 3,396,501, U.S. Pat. No. 3,811,237 or U.S. Pat. No. 4,426,824, etc.

Accordingly, in cases where cables are to be moved (e. g., even light cables such as communications cables, etc.), it is necessary to remove and then re-install the floor panels. This leads to difficulties: i. e., the floor panels are heavy, and rattling may result from panels being left loose at the time of re-installation. Ordinarily, specialists are required for such panel removal and re-installation. In order to avoid such problems, undercarpet type cables which are laid on the floor surface have been used. In this case, however, there are restrictions on the cross-sectional shape of the cables and on the number of cables that can be laid. Furthermore, since underfloor wiring is naturally impossible in such a case, there are difficulties in using such a system for the laying of power cables. Moreover, in cases where power cables and communications cables are to be laid mixed together, it is desirable to lay the two types of cables separately using ducts, etc. Conventional free-access floors have not been able to cope successfully with such difficulties and requirements.

SUMMARY OF THE INVENTION

The free-access floor of the present invention was developed in order to eliminate the abovementioned problems encountered in the prior art. A special feature of this free-access floor is as follows: i. e., a step (5) is formed around the periphery of each floor panel (1), so that wiring channels (3) are formed between the side surfaces of adjacent floor panels (1) when said floor panels (1) are installed.

These wiring channels (3) may be formed by the side surfaces of the floor panels (1) themselves and the aforementioned steps (5), or may be formed by channel-form cable carriers which are inserted into the channel-form spaces formed between the side surfaces of adjacent floor panels. Furthermore, the wiring channels formed in this way are covered by wiring covers, so that there are no indentations or projections between the floor panels.

The wiring channels (3) constructed as described above are located in the free-access floor surface, and allow wiring in the free-access floor . Since these wiring spaces are installed in channel form, cables laid above the floor can be accommodated separately from cables laid beneath the floor. Furthermore, wiring is possible after the assembly of the free-access floor, and in the case of movement or repair of cables occurring in ordinary layouts, etc., the work can be accomplished without any removal of the floor panels, etc.

DETAILED DESCRIPTION OF THE INVENTION

Figure 1:
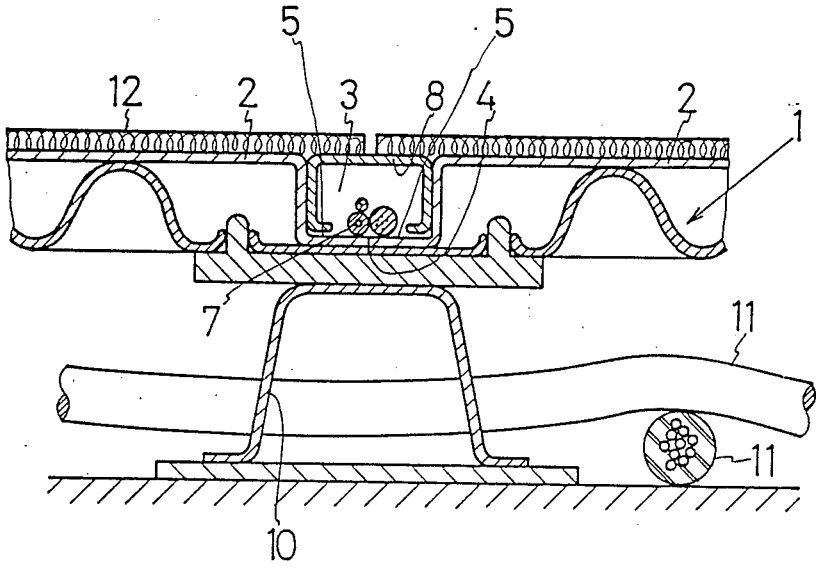
FIG. 1 is a longitudinal section which illustrates one appropriate embodiment of the present invention.
Figure 2:
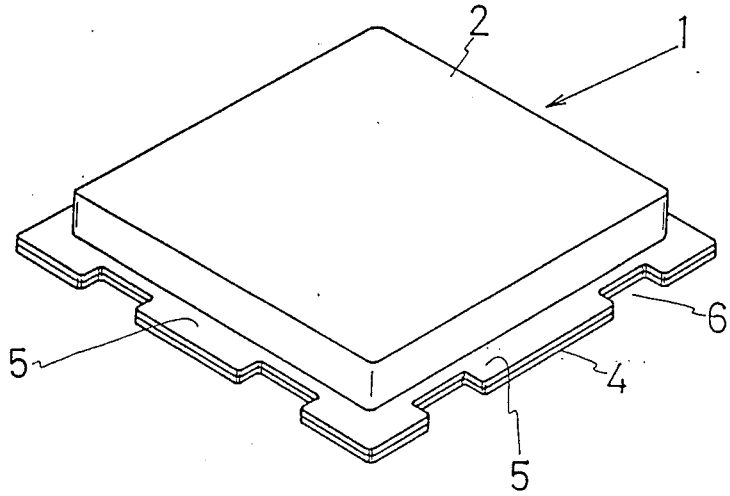
FIG. 2 is an oblique view of one of the floor panels.

Below, appropriate embodiments of the present invention will be described in detail with reference to the attached figures:

In the first embodiment of the free-access floor illustrated here, the floor panels (1) are square panels which are made of steel. Projecting rim parts (4) are formed as flanges along the four sides of each floor panel. These projecting rim parts (4) act as steps (5), so that wiring channels (3) are formed between adjacent floor panels. Connecting passages (6) which connect the space above the floor with the space beneath the floor are formed by means of partial cut-outs in the aforementioned projecting rim parts (4). The depth of the wiring channels (3) is determined by the distance between the floor surface (2) of the floor panels and the aforementioned projecting rim parts (4).

Figure 3:
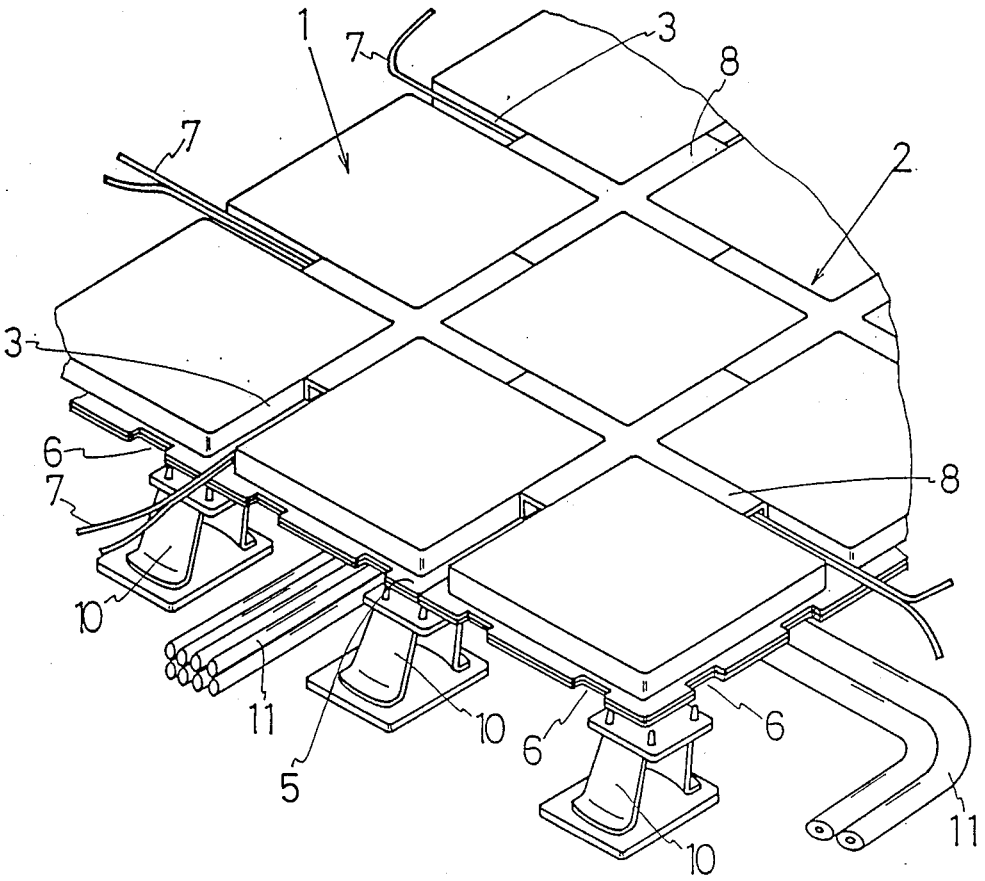
FIG. 3 is an oblique view of the embodiment in FIG. 1 prior to carpet laying.
Figure 4:
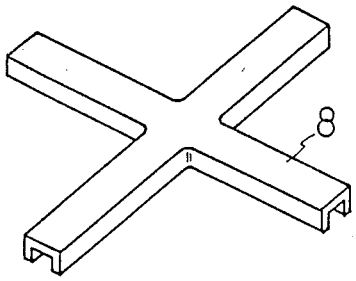
FIG. 4 is an oblique view of one of the wiring covers in the same embodiment.
Figure 5:
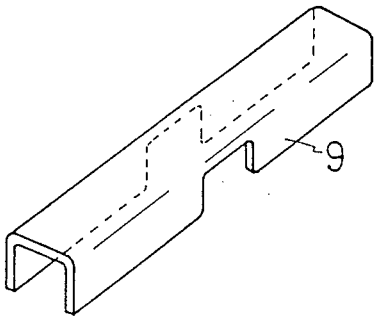
FIG. 5 is an oblique view of another embodiment of the wiring cover.

Wiring channels (3) which are connected longitudinally and laterally are formed in the floor surface (2) that is formed by installing a multiple number of such floor panels (1). In this embodiment, the wiring channels (3) are formed between adjacent floor panels (1), with the side surfaces of the floor panels themselves and the aforementioned projecting rim parts (4) forming the side walls and bottom of each channel as is shown in the figures. Communications cables (7) can be laid in these wiring channels (3) as shown in FIGS. 1 and 3. Then, a free-access floor with a smooth floor surface free of indentations or projections is obtained by installing cross-form wiring covers (8) such as that shown in FIG. 4, or linear wiring covers (9) with intermediate cut-outs such as that shown in FIG. 5, both types of covers being channel-form in cross section, over the aforementioned cables.

The floor panels (1) are supported from below by means of supporting legs (10). Each of these supporting legs (10) consists of a base part, a stand part and a support part; the support part has a flat top and projections which engage with the floor panels. Power cables (11) can be laid beneath the floor panels (1) as in conventional free-access floors; thus, communications cables (7) and power cables (11) can be separated from each other. Despite the fact that they are installed on the floor surface, the aforementioned communications cables (7) are covered by the aforementioned wiring covers and a carpet (12) which is laid over the floor, so that said cables cannot be seen from the surface.

Figure 6:
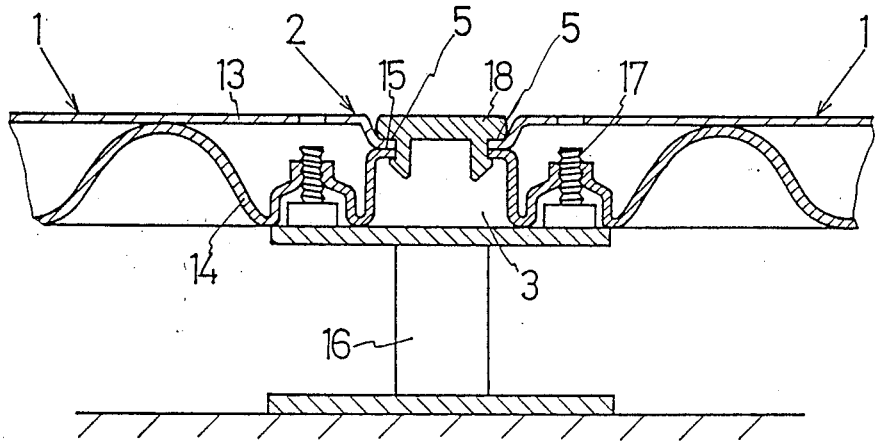
FIGS. 6 through 8 are longitudinal sections which illustrate other embodiments of the present invention.

FIG. 6 is a longitudinal section which illustrates a second embodiment of the present invention. In this embodiment, a rim part (15) formed by joining the steel top plate (13) and bottom plate (14) which form each floor panel (1) is located around the upper part of the side surfaces of each floor panel (1) near the floor surface (2). This rim part (15) constitutes the aforementioned step (5). WIring channels (3) are formed by leaving an appropriate space between adjacent floor panels (1) supported by supporting legs (16). The floor panels (1) are installed so that their level can be adjusted by screws (17) in the supporting legs (16) which connect with the corner portions of the bottom plates (14). Cap-form wiring covers (18) consisting of long plates equipped with engaging ribs are fit over the wiring channels (3) from above.

Figure 7:
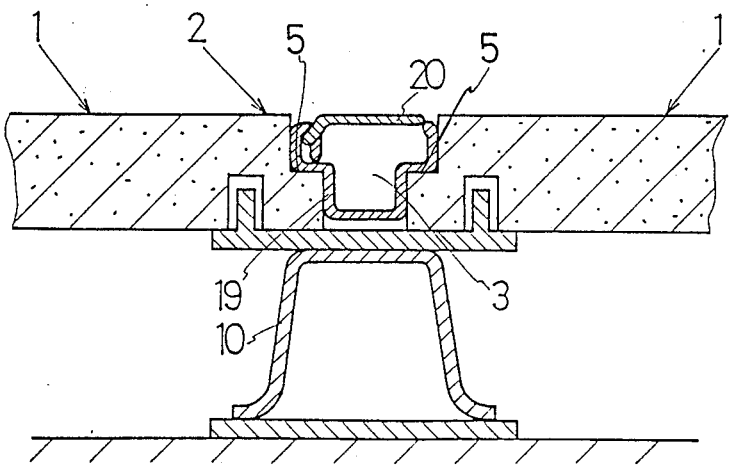

FIG. 7 is a longitudinal section which illustrates a third embodiment of the present invention. In this embodiment, the floor panels (1) consist of an inorganic material such as calcium silicate, etc. A step (5) of relatively small width is formed at an intermediate point around each side surface of each floor plate (1), and wiring channels (3) are formed by leaving a prescribed space between adjacent floor panels (1). A cable carrier (19) whose shape conforms to the shapes of the aforementioned step parts (5) is inserted into the interior of each wiring channel (3), and a wiring cover (20) in installed over each of these cable carriers (19), with one side hinged so that the wiring cover (20) can be opened and closed.

Figure 8:
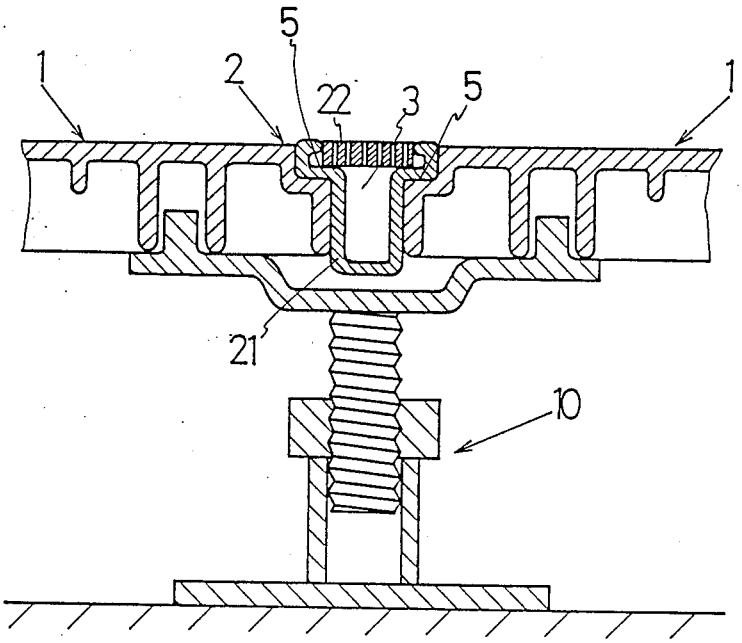

FIG. 8 is a longitudinal section which illustrates a fourth embodiment of the present invention. In this embodiment, the floor panels (1) are made of die-cast aluminum. In this example as well, steps (5) of relatively small width are formed at an intermediate point around the side surfaces of the floor panels (1), and wiring channels (3) are formed by leaving a space of a prescribed width between adjacent floor panels (1). As in the aforementioned third embodiment, cable carriers (21) whose shapes conform to the shapes of the aforementioned steps (5) are inserted into these wiring channels (3). Wiring covers (22) which are made of punched metal so that the wires inside can be seen are installed over these cable carriers (21).

Wiring channels such as those described above are not restricted to square floor panels; such channels may also be similarly utilized in the case of triangular floor panels.

Since the free-access floor of the present invention is constructed as described above, wiring spaces are formed in the upper surface of the floor panels. Accordingly, communications cables etc. and power cables etc. can be laid separately above and below the floor panels, and cable laying work can be performed after the assembly of the free-access floor. Furthermore, in cases where cables are to be moved because of ordinary changes in office layout, etc., the cable moving work can be easily performed merely by removing simple wiring covers, without any need for the removal of the larger floor panels.

We claim:

1. A free-access floor comprising a plurality of floor panels, and steps continuously formed around the peripheries of each of the respective plurality of floor panels whereby wiring channels opening upwards and having wide spaces necessary to hold electrical wires are formed between side surfaces of adjacent floor panels when said floor panels are installed, the steps around the peripheries of the aforementioned floor panels being flange-form projecting rim parts which are formed around bottom edges of four sides of each floor panel, connecting passages which connect a space above the floor panels with a space beneath the floor panels being formed by partial cutouts in said projecting rim parts, said connecting passages in which electric wires are passed through, and wherein wiring covers cover the wiring channels which are formed between adjacent floor panels with the aforementioned projecting rim parts constituting the bottoms of said wiring channels.

* * * * *